US007958946B2

(12) United States Patent
Kurzenberger et al.

(10) Patent No.: US 7,958,946 B2
(45) Date of Patent: Jun. 14, 2011

(54) HANDHELD WORK APPARATUS

(75) Inventors: Jan Kurzenberger, Köngen (DE); Alexander Kraus, Bad Ditzenbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 85 days.

(21) Appl. No.: 12/149,866

(22) Filed: May 9, 2008

(65) Prior Publication Data

US 2008/0277130 A1 Nov. 13, 2008

(30) Foreign Application Priority Data

May 9, 2007 (DE) ..... 10 2007 021 633

(51) Int. Cl.
*B25D 17/04* (2006.01)

(52) U.S. Cl. ..... 173/170; 173/171; 173/162.2; 74/491

(58) Field of Classification Search ..... 173/162.1, 173/162.2, 216, 170, 171, 215; 74/491, 501.5 H, 74/501.5 R, 501.6, 502.4, 504, 519, 523
See application file for complete search history.

(56) References Cited

U.S. PATENT DOCUMENTS

| | | | | | |
|---|---|---|---|---|---|
| 4,302,880 | A | * | 12/1981 | Elfving et al. | 30/382 |
| 4,592,445 | A | * | 6/1986 | Sawada | 181/229 |
| 4,785,539 | A | * | 11/1988 | Nagashima | 30/381 |
| 4,896,425 | A | * | 1/1990 | Henriksson | 30/381 |
| 5,029,393 | A | * | 7/1991 | Nagashima et al. | 30/383 |
| 5,142,934 | A | * | 9/1992 | Persson et al. | 74/502.4 |
| 7,269,904 | B2 | | 9/2007 | Schmidt et al. | |
| 2005/0183270 | A1 | * | 8/2005 | Schmidt et al. | 30/381 |

* cited by examiner

*Primary Examiner* — Paul R Durand
(74) *Attorney, Agent, or Firm* — Walter Ottesen

(57) ABSTRACT

A handheld work apparatus has a housing (2) wherein an internal combustion engine (10) and a fuel-metering unit for the engine (10) are mounted. A throttle lever (6) is provided which is pivotally journalled on a handle (3). The handle (3) is connected to the housing (2) via at least one antivibration element (33). A vibration gap (9) is formed between the handle (3) and the housing (2). A transmitting unit (13) is provided for transmitting the pivot movement of the throttle lever (6) to the fuel-metering unit. The transmitting unit (13) includes a rigid transmitting element (17, 77) which bridges the vibration gap (9). The transmitting element (17, 77) is rotatably journalled on at least one bearing (18, 19, 59) and transmits the pivot movement of the throttle lever (6) as a rotation about a rotational axis (22) lying transversely to the vibration gap (9). A first bearing (19, 59) of the transmitting element (17, 77) is located on the fuel-metering unit.

12 Claims, 6 Drawing Sheets

HANDHELD WORK APPARATUS

CROSS REFERENCE TO RELATED APPLICATION

This application claims priority of German patent application no. 10 2007 021 633.7, filed May 9, 2007, the entire content of which is incorporated herein by reference.

FIELD OF THE INVENTION

The invention relates to a handheld work apparatus such as a motor-driven chain saw, cutoff machine, brushcutter or the like.

BACKGROUND OF THE INVENTION

U.S. Pat. No. 7,269,904 discloses a handheld work apparatus wherein the actuating movement from the throttle lever to the carburetor of the internal combustion engine of the work apparatus is transmitted via a transmitting element which runs transversely to the vibration gap. The movement is transmitted as a rotation about a rotational axis lying transversely to the rotation gap.

SUMMARY OF THE INVENTION

It is an object of the invention to provide a handheld work apparatus of the kind described above wherein the adjusting movement of the throttle lever is substantially decoupled from operating vibrations and movements during operation.

The handheld work apparatus of the invention includes: a housing; an internal combustion engine mounted in the housing; a fuel-metering unit for metering fuel to the internal combustion engine and the fuel-metering unit also being mounted in the housing; a handle; at least one antivibration element connecting the handle to the housing; the handle and the housing conjointly defining a vibration gap therebetween; a throttle lever pivotally journalled on the handle so as to execute a pivotal movement; a transmitting unit for transmitting the pivotal movement of the throttle lever to the fuel-metering unit; the transmitting unit including: a rigid transmitting element for bridging the vibration gap; and, support means for rotatably supporting the transmitting element so as to permit rotation thereof about a rotational axis transverse to the vibration gap; interface means for operatively connecting the throttle lever to the transmitting element so as to cause the transmitting element to transmit the pivotal movement as a rotation about the rotational axis; and, the support means including a bearing unit located on the fuel-metering unit and the bearing unit being configured to rotatably support the transmitting element.

Tolerances between the bearing and the fuel-metering unit can be minimized by fixing the first bearing of the transmitting is element onto the fuel-metering unit. The fixing of the first bearing on the fuel-metering unit furthermore makes possible to minimize the distance between the bearing and the actuation of the fuel-metering unit. In this way, the influence of relative movements of the handle to the housing transversely to the rotational axis of the transmitting element are minimized. A simple configuration results by locating the first bearing on the fuel-metering unit.

The fuel-metering unit has a pivotally journalled throttle shaft on which the transmitting unit operates. Advantageously, it is provided that the first bearing is arranged on the throttle shaft. The distance between the bearing and the actuation of the throttle shaft is minimized because the first bearing is itself located on the throttle shaft. The tolerances between the bearing and the throttle shaft, which are to be considered, are minimized. A simple configuration results when the first bearing is formed on a bearing element arranged rotatably on the throttle shaft. The bearing element determines the distance of the bearing of the transmitting element to the pivot axis of the throttle shaft. To compensate for tolerances, it can also be provided that this distance is variable or adjustable, for example, via a corresponding adjusting device on the bearing element.

The first bearing can also be mounted on a connecting flange of the fuel-metering unit. This too provides a simple configuration as well as a short distance to the actuation of the throttle shaft and few tolerances which have to be considered. It can be advantageous that the position of the first bearing is adjustable to compensate for tolerances. In this way and especially in the manufacture of the work apparatus, the position of the first bearing can be set one time while considering the actual configuration of the transmitting element. A simple configuration results when the first bearing has an opening which extends in the direction of the rotational axis and the transmitting element extends therethrough.

A contact element is provided which has at least one contact region on which the transmitting element acts. Advantageously, the contact element has at least two contact regions. The two contact regions are advantageously differently configured. The contact element can be mounted in a first position on the throttle shaft whereat the first contact region is actuated by the transmitting element and in a second position whereat the second contact region is actuated. The different configuration of the two contact regions facilitates the selection of a suitable contact region in a simple manner during the assembly of the contact element. The two contact regions differ especially with respect to the distance of the contact region to a center axis of the attachment of the contact element. In this way, each contact region comes into contact with the transmitting element at a different position of the throttle lever. With a suitable selection and arrangement of a contact region, the actuation of the fuel-metering unit can be so adjusted that a throttle element of the fuel-metering unit can be actuated between an idle position and a full-load position. At least one contact region of the contact element is made of plastic to reduce the friction between the transmitting element and contact element. The contact element especially consists completely of plastic.

A second bearing of the transmitting element is advantageously arranged next to the handle. Advantageously, the second bearing includes a receptacle which is configured on the housing, wherein the transmitting element is arranged and is especially secured by a section of the rearward handle. In this way, a simple assembly is made possible. The transmitting element is securely held in the second bearing.

The handle advantageously has a first handle shell formed on a handle housing of the work apparatus and a second handle shell arranged on the first handle shell. Advantageously, the second handle shell secures the transmitting element in the receptacle. In the first handle shell, the throttle lever can be assembled together with the throttle lever lock and spring element. Here, the transmitting element is also mounted in the receptacle of the housing. The second handle shell of the handle secures the throttle lever and the throttle lever lock in the first handle shell as well as the transmitting element in the receptacle. After the assembly of the second handle shell, all components are thereby securely held. This leads to a simple and reliable assembly. An advantageous configuration results when the second handle shell has a U-shaped bracket which engages over the receptacle of the second bearing. In this way, the relative position of the bracket to the bearing is fixed. A guide for the throttle lever is advantageously formed onto the second handle shell.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
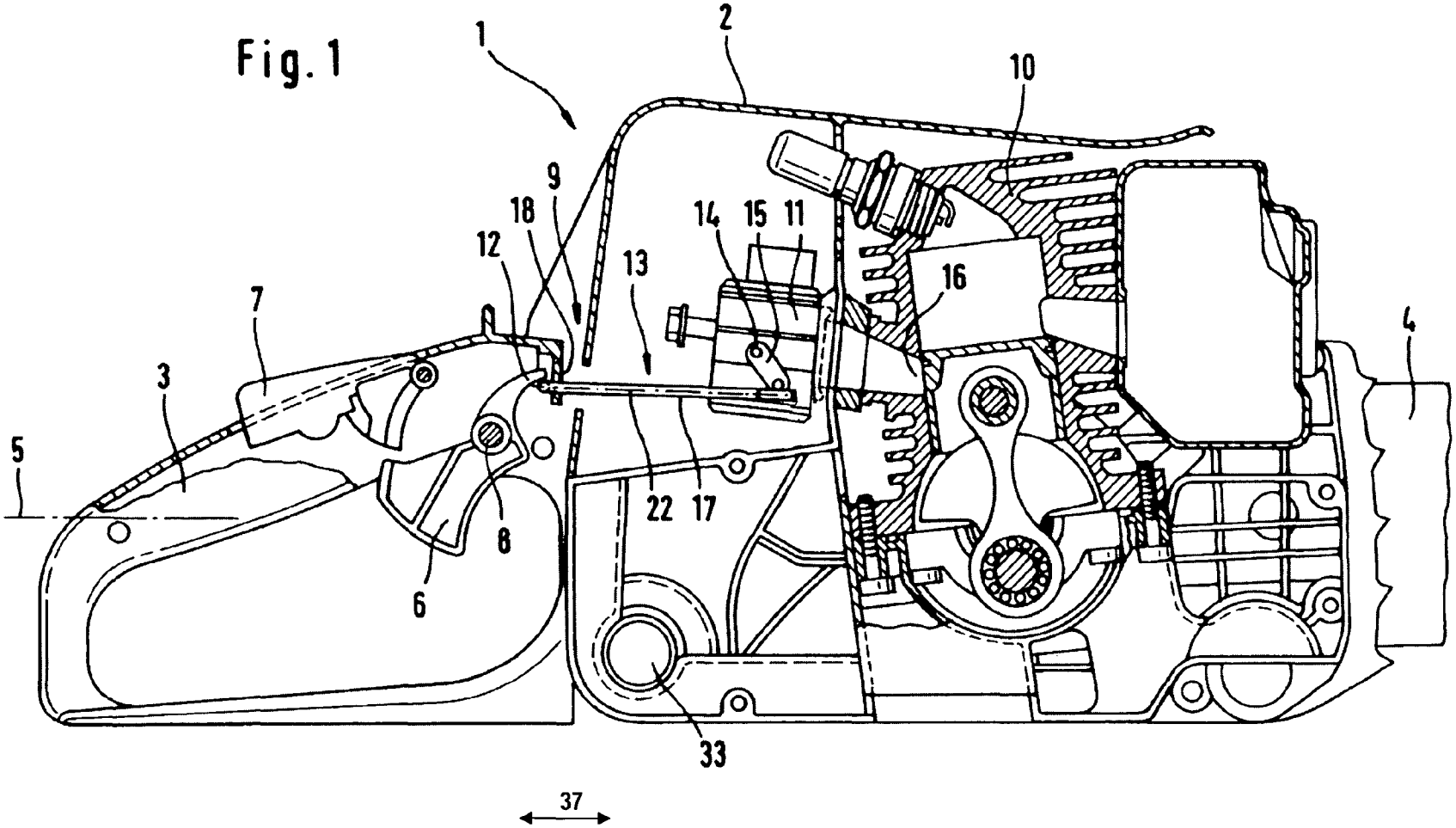
FIG. 1 is a schematic section view of a motor-driven chain saw.

FIG. 1 shows a motor-driven chain saw 1 as an embodiment for a handheld work apparatus. The invention can, however, also be utilized in other handheld and especially portable work apparatus such as cutoff machines, brushcutters or the like. The motor-driven chain saw 1 has a housing 2 on which a rearward handle 3 is arranged. A guide bar 4 projects forwardly on the end of the housing 2 lying opposite the rearward handle 3. A saw chain (not shown in FIG. 1) is arranged to run along the periphery of the guide bar 4.

A throttle lever 6 is pivotally journalled on the rearward handle 3 with a bearing pin 8. Furthermore, a throttle lever lock 7 is journalled on the rearward handle 3. The throttle lever lock 7 prevents an unintended actuation of the throttle lever 6. The throttle lever lock 7 must be pressed to actuate the throttle lever 6.

The throttle lever 6 serves for operating an internal combustion engine 10. The internal combustion engine 10 is configured as a single cylinder engine, especially, a two-stroke engine. The internal combustion engine 10 can, however, also be configured as mixture-lubricated four-stroke engine.

A fuel-metering unit is provided in the housing 2 for the internal combustion engine 10 and is configured as a carburetor 11. An air/fuel mixture is prepared in the carburetor 11 and flows via an inlet 16 into the crankcase of the engine 10. To control the fuel quantity, which is supplied to the air/fuel mixture, the carburetor 11 has a throttle flap (not shown in FIG. 1) which is mounted on a pivotally journalled throttle shaft 14. A lever 15 is mounted on the throttle shaft 14 on the outer side of the housing of the carburetor 11. The throttle lever 6 acts via a transmitting device 13 on the lever 15 to transmit the pivot movement of the throttle lever 6 to the throttle shaft 14. The transmitting device 13 includes a transmitting element 17. The transmitting element 17 is supported at a second bearing 18 next to the rearward handle 3. A first bearing (not shown in FIG. 1) is provided on the carburetor 11. In this way, the transmitting element 17 is pivotable about a rotational axis 22. The throttle lever 6 has an actuating section 12, which acts on the transmitting element 17 next to the second bearing 18, and pivots the transmitting element 17 about the rotational axis 22.

The rearward handle 3 is part of a handle housing of the motor-driven chain saw 1. The handle housing is connected to the housing 2 of the motor-driven chain saw 1 via antivibration elements 33 of which one is shown in FIG. 1. A vibration gap 9 is formed between the rearward handle 3 and the housing 2. The vibration gap 9 permits relative movements between the rearward handle 3 and the housing 2 during operation. Because of the forces acting during operation on the guide bar 4, a main direction of movement 37 results for the motor-driven chain saw 1 which lies in a longitudinal direction 5 of the chain saw 1 parallel to the longitudinal direction of the guide bar 4 and wherein handle 3 and housing 2 move relative to each other during operation. The rotational axis 22 of the transmitting element 17 lies transversely to the vibration gap 9 and approximately in the main direction of movement 37. Because the pivot movement of the throttle lever is transmitted to the throttle shaft 14 as a rotation about the rotational axis 22, relative movements of the housing 2 and the rearward handle 3 in the direction of the rotational axis 22 (that is, in the main direction of movement 37) have no or only a negligibly small influence on the adjusting movement. The adjusting movement is substantially decoupled from vibrations and relative movements in the main direction of movement.

Figure 2:
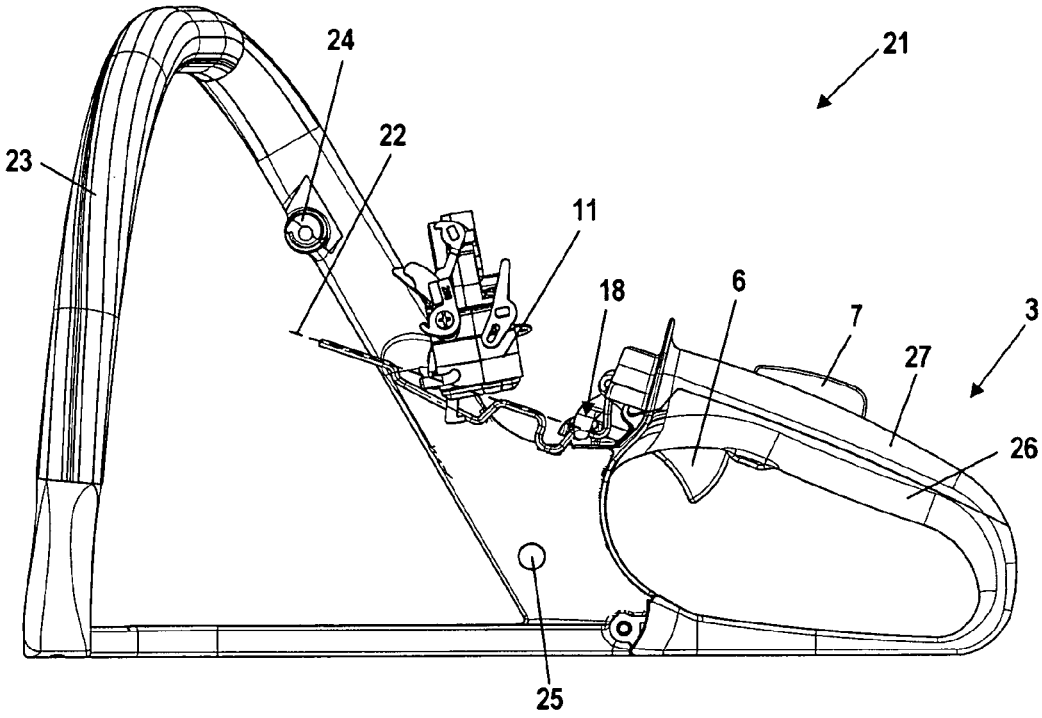
FIG. 2 is a schematic of the handle housing and of the carburetor of the motor-driven chain saw of FIG. 1.

As FIG. 2 shows, the rearward handle 3 is part of the handle housing 21. In addition to the rearward handle 3, the handle housing 21 includes a handle tube 23 which extends over the housing 2 of the chain saw 1 next to the front end of the chain saw 1 which lies facing toward the guide bar 4. Holders 24 and 25 are arranged on the handle housing 21 for additional antivibration elements (not shown) between the handle housing 21 and the housing 2 of the chain saw 1. The carburetor 11 is also shown in FIG. 2 and is located on the housing 2. The rearward handle 3 includes a first lower handle shell 26 which is configured as one piece with the handle housing 21. A second upper handle shell 27 is located on the first, lower handle shell 26. The handle shell 27 closes off the rearward handle 3.

Figure 3:
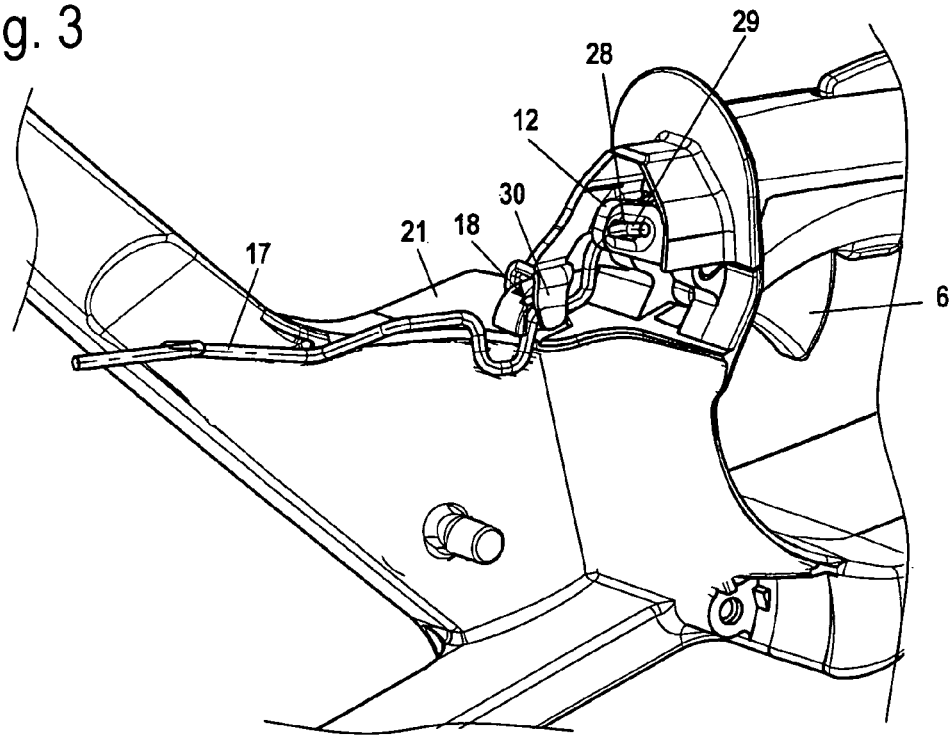
FIG. 3 is a perspective view of the bearing of the transmitting element next to the handle.

As shown also in FIG. 3, the second bearing 18 is arranged on the handle housing 21 next to the rearward handle 3. FIG. 3 further shows the coupling of the transmitting element 17 to the actuating section 12 of the throttle lever 6. The actuating section 12 has a slot 28 wherein a bent-over end 29 of the transmitting element 17 is guided. In the embodiment, the transmitting element 17 is configured as a rotating rod. The transmitting element 17 is configured as a bent rod. In this way, a simple manufacture of the rod results.

Figure 4:
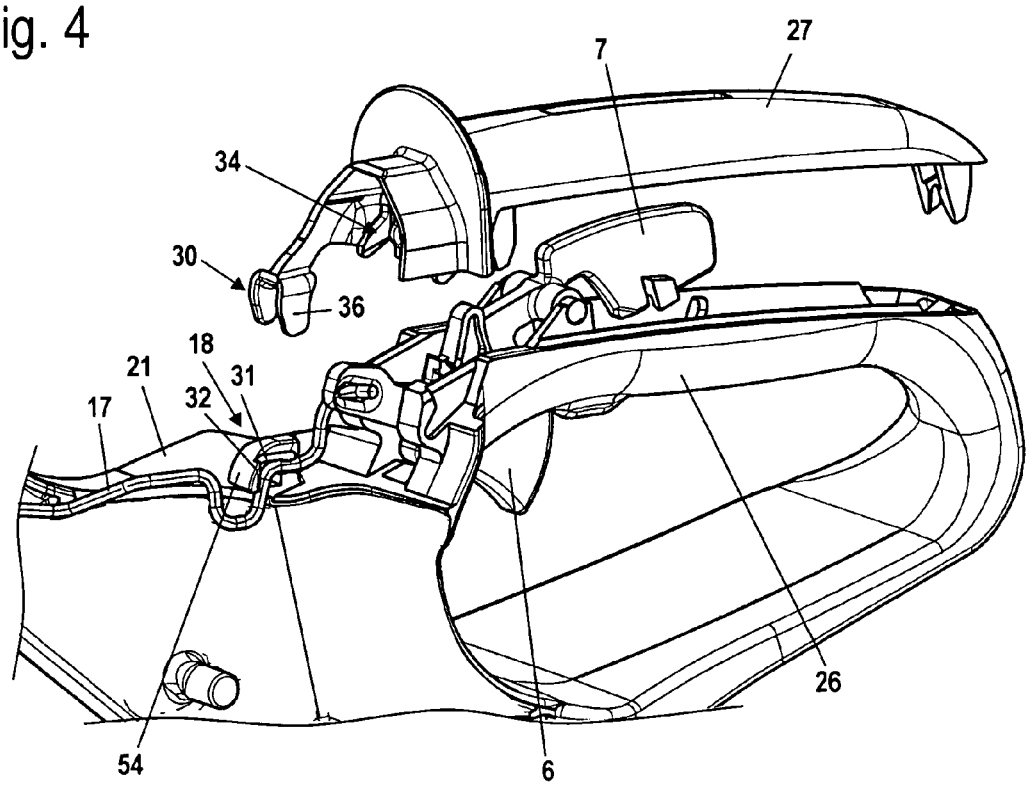
FIG. 4 shows an opened handle of the motor-driven chain saw in a perspective view.
Figure 5:
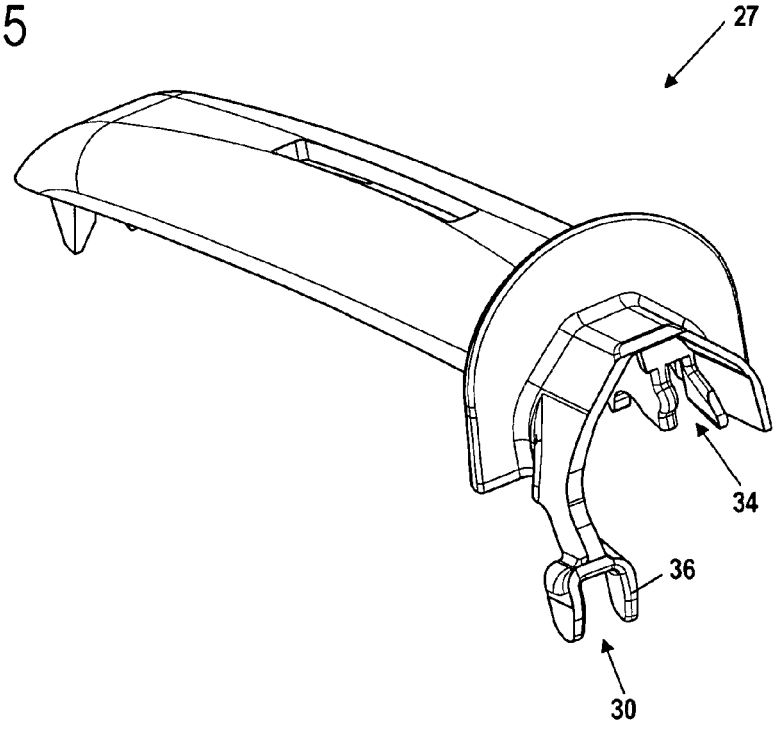
FIG. 5 is a perspective view of the upper handle shell of the handle.

As shown in FIGS. 3 to 5, the second bearing 18 includes a receptacle 31 which is formed on the handle housing 21. The receptacle 31 includes a stop 32 which fixes the transmitting element 17 in the longitudinal direction 5 of the chain saw 1.

A fixation 30 is formed in the second bearing 18 for the transmitting element 17 on the second, upper handle shell 27. The fixation 30 includes a U-shaped bracket 36 which engages over a lug 54 on which the receptacle 31 is configured. The bracket 36 thereby holds the position of the transmitting element 17 in the receptacle 31.

As shown in FIG. 5, the second handle shell 27 further includes a guide 34 for the throttle lever 6 which lies against the actuating section 12 of the throttle lever 6 on both sides. As shown in FIG. 4, the throttle lever, the throttle lever lock 7 as well as spring elements assigned thereto can be mounted in the lower handle shell 26 during the assembly. Furthermore, the transmitting element 17 can be arranged in the receptacle 31. Thereafter, the lower handle shell 26 and the receptacle 31 are closed off by the upper handle shell 27 and the fixation 30 formed on the upper handle shell 27.

Figure 6:
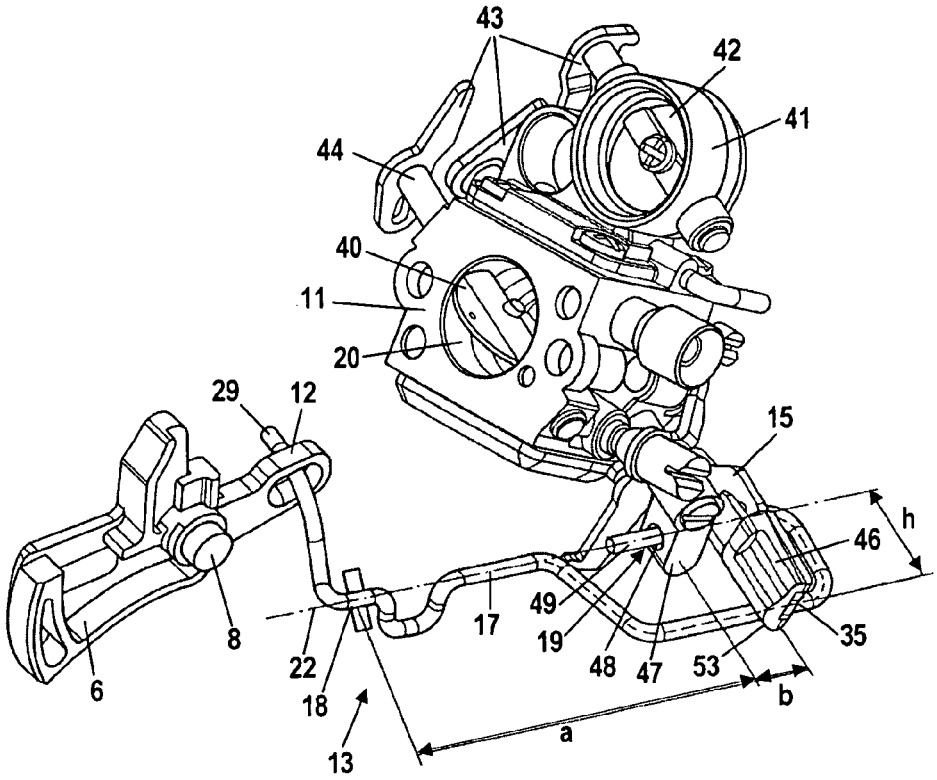
FIG. 6 is a perspective view of the throttle lever, transmitting element and carburetor of the motor-driven chain saw at idle.

The configuration and function of the transmitting unit 13 is shown in FIGS. 6 to 10. As shown in FIG. 6, an air channel section 41 is arranged on the carburetor 11 wherein an air flap 42 is pivotally journalled. The air channel section 41 functions to supply scavenging advance air to the internal combustion engine 10. No air channel section 41 is needed if the internal combustion engine 10 is not configured as a scavenging advance engine.

Figure 7:
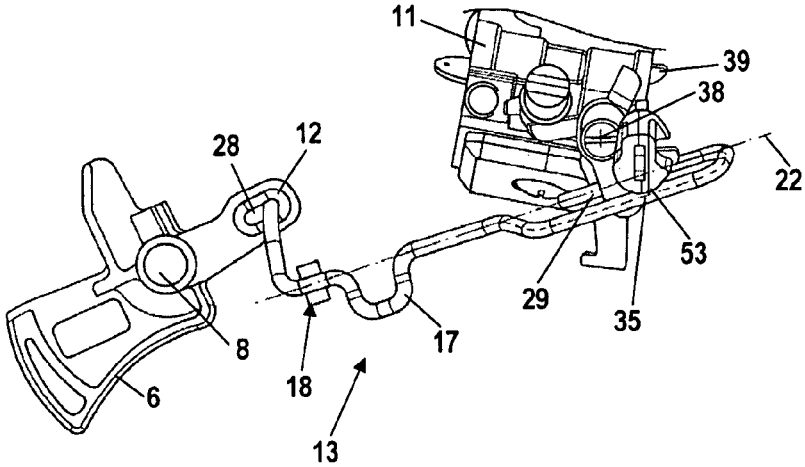
FIG. 7 shows the arrangement of FIG. 6 in a side elevation view.
Figure 8:
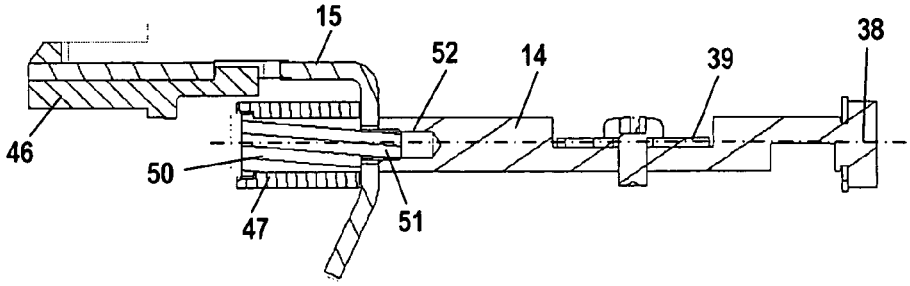
FIG. 8 is a section view through the throttle shaft of the carburetor shown in FIGS. 6 and 7.
Figure 9:
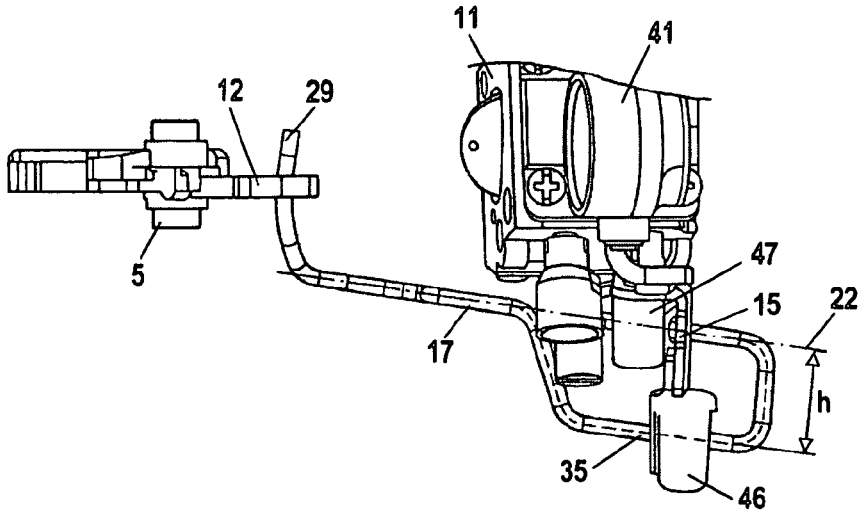
FIG. 9 is a plan view of the arrangement of FIGS. 6 and 7.

In the carburetor 11, an intake channel 20 is formed wherein the choke flap 40, which is shown in FIG. 6, and the throttle flap 39, which is indicated in FIG. 7, are pivotally journalled. The choke flap 40 is mounted upstream of the throttle flap 39. The choke flap 40 is pivotally journalled on a choke shaft 44. The throttle flap 39 is mounted on the throttle shaft 14 (FIG. 8). The positions of the throttle flap 39, choke flap 40 and air flap 42 are coupled to each other via coupling levers 43.

The transmitting element 17 is pivotable about the rotational axis 22 on a first bearing 19 and on a second bearing 18. The first bearing 19 is formed on the carburetor 11. For this purpose, the bearing element 47, which is also shown in FIG. 8, is pivotally journalled on the throttle shaft 14. As shown in FIG. 8, the bearing element 47 is held by an attachment pin 50. The attachment pin 50 has a threaded pin 51 which threadably engages in an internal thread 52 of the throttle shaft 14. The throttle shaft 14 is rotatably journalled about a rotational axis 38 on the carburetor 11. The attachment pin 50 functions also to fix the lever 15 on the throttle shaft 14 in the direction of the rotational axis 38 of the throttle shaft 14. The lever 15 is held on the throttle shaft 14 so as to rotate therewith. For this purpose, a profile (not shown), especially a surface profile, is formed on the throttle shaft 14.

As shown in FIG. 6, the bearing element 47 has an opening 48 through which one end 49 of the transmitting element 17 projects. The end 49 is bent over and points in the direction toward the second bearing 18.

The transmitting element 17 has an actuating section 35 for actuating the throttle shaft 14. The actuating section 35 is arranged at a distance (h) to the rotational axis 22. The actuating section 35 carries out a movement transverse to the rotational axis 38 of the throttle shaft 14 when there is a pivot movement of the transmitting element 17 about the rotational axis 22.

The lever 15 shown in FIG. 8 is fixed on the throttle shaft 14 so as to rotate therewith. A contact element 46 is pushed onto the lever 15. The contact element 46 lies against the actuating section 35 of the transmitting element 17 when there is an actuation of the throttle lever 6. The transmitting unit 13 is shown at idle in FIG. 7. The throttle lever 6 is not actuated. In this position, there can also be a distance between the contact element 46 and the actuation section 35 which is passed through with further actuation of the throttle lever 6.

Figure 10:
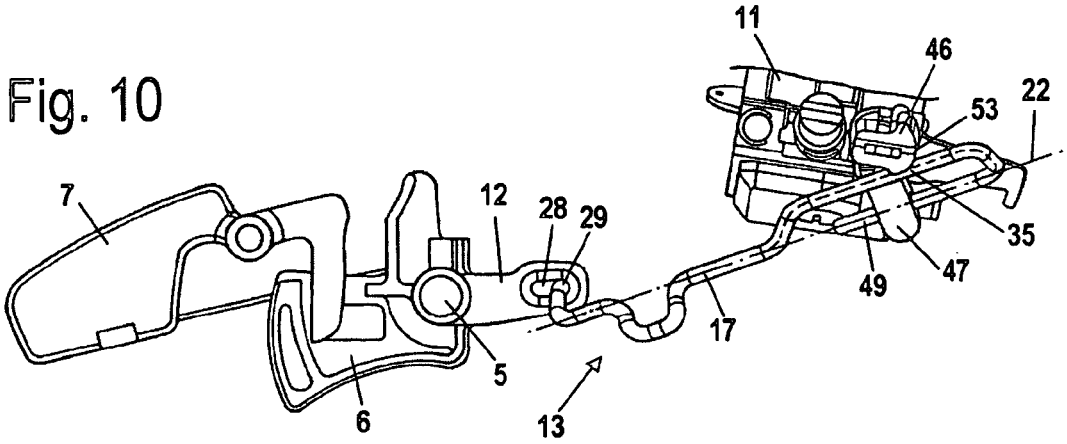
FIG. 10 is a side elevation view of the arrangement of FIG. 7 in the full throttle position.

FIG. 10 shows the transmitting unit 13 for the full throttle position. The throttle lever 6 is completely actuated. Compared to the illustration in FIG. 7, the actuating section 12 has pivoted the end 29 of the transmitting element 17 about the rotational axis 22. In this way, the actuating section 35 was also pivoted. The end 49 of the transmitting element 17 has rotated in the opening 48 (FIG. 6). Because of the movement of the actuating section 35, which acts on a contact region 53 of the contact element 46, the lever 15 and therewith the throttle shaft 14 were pivoted about the rotational axis 38 of the throttle shaft 14. The throttle flap 39 is in the completely open position for the position of the transmitting unit 13 shown in FIG. 10.

As shown in FIG. 6, the first bearing 19 is at a distance (a) to the second bearing 18. The first bearing 19 is at a distance (b) to the contact region 53 and this distance (b) changes during the actuation of the contact element 46 because of the pivot movement. The distance (b) between the first bearing 19 and the contact region 53 of the contact element 46 is considerably less than the distance (a). Both distances (a, b) are measured parallel to the rotational axis 22. Because the distance (a) is considerably greater than the distance (b), relative movements between housing 2 and handle 3 transversely to the vibration gap 9 are transferred only slightly to the position movement of the throttle shaft 14. In the ratio of the distances (b) to (a), the transverse vibrations are reduced. The arrangement of the bearing element 47 of the first bearing 19 on the throttle shaft 14 thereby minimizes the transfer of relative movements from housing 2 and rearward handle 3 via the transmitting unit 13. In this way, the adjusting movement of the throttle lever 6 can be transmitted to the throttle shaft 14 and the throttle flap 39 substantially independent of relative movements.

Relative movements between the rearward handle 3 and the housing 2 in the main direction of movement 37 shown in FIG. 1 lead to a relative movement of the transmitting element 17 relative to the housing 2 with the carburetor 11 because the transmitting element 17 is held against the stop 32 of the handle housing 21 in the direction of the rotational axis 22. In this way, the actuating section 35 moves relative to the contact region 53 and the end 49 moves relative to the opening 48. In order to ensure the function of the transmitting unit 13 during operation, the actuating section 35 and the region extending at the end 49, with which the transmitting element 17 is arranged in the opening 48, have lengths in the direction of the rotational axis 22 which correspond at least to the maximum permissible relative movement of the handle housing 21 and the housing 2 in the direction of the rotational axis 22.

The support of the transmitting element 17 on the throttle shaft 14 is not shown in FIGS. 2 to 4. The support of the transmitting element 17 is, however, configured here as shown in FIGS. 7 to 10.

Figure 11:
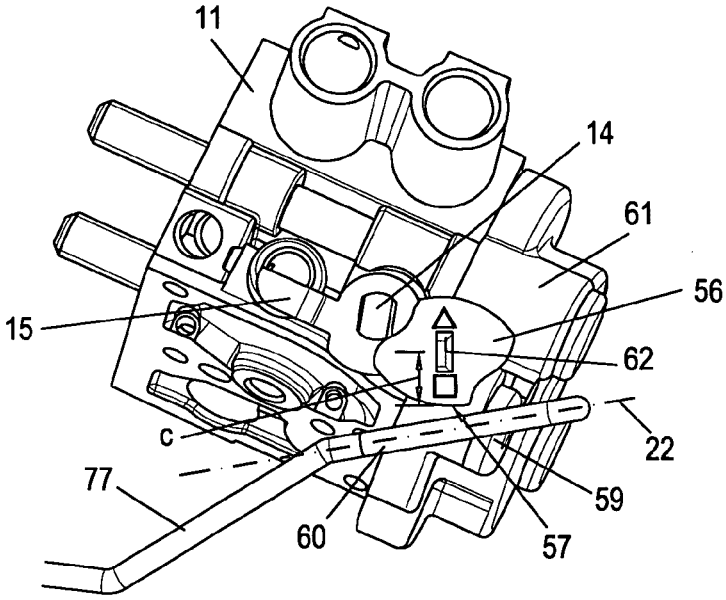
FIG. 11 is a side perspective view of a carburetor with a contact element in a first position.
Figure 12:
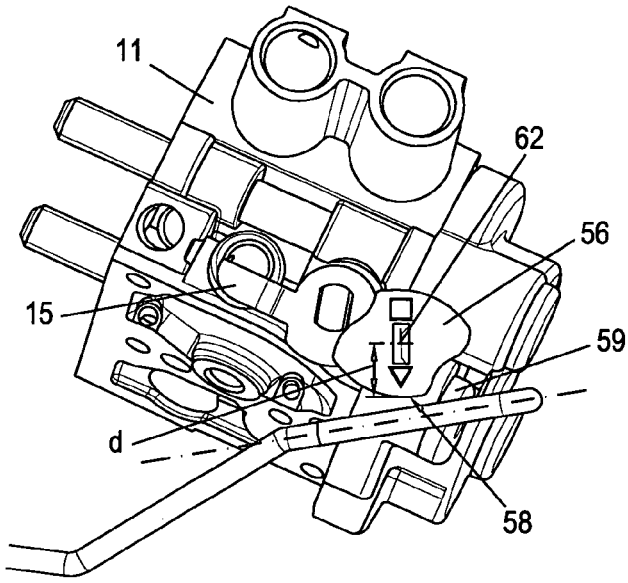
FIG. 12 is a side perspective view of the carburetor of FIG. 11 with the contact element in a second position.
Figure 13:
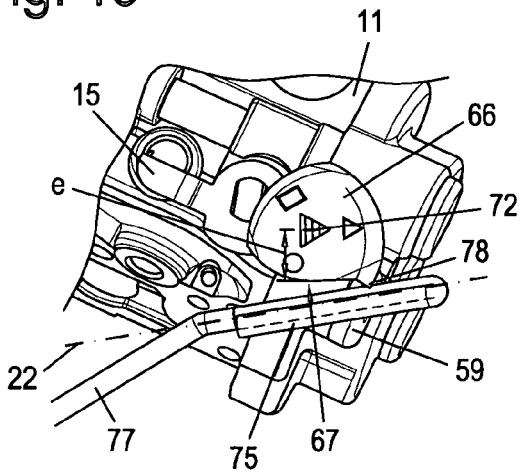
FIG. 13 is a perspective view of a carburetor having a contact element in a first position.

An embodiment of a transmitting element 77 is shown in FIGS. 11 to 15. The transmitting element 77 has an actuating section 75 which is configured at an end 60 of the transmitting element 77 which is bent over and projects in the direction toward the rearward handle 3. A first bearing 59 of the transmitting element 77 is configured on a connecting flange 61 fixed to the carburetor 11. The transmitting element 77 projects through the bearing 59. For this purpose, the bearing 59 has an opening 78 which is shown in FIG. 13 and which extends in the direction of the rotational axis 22 of the transmitting element 77. At the handle end, the transmitting element 77 is configured in correspondence to the transmitting element 17 and is supported.

The transmitting element 77 is configured as a bent wire. In order to compensate for tolerances of manufacture of the transmitting element 77, a contact element 56 is shown on the lever 15 in FIGS. 11 and 12 and this contact element has a first contact region 57 and a second contact region 58. The two contact regions 57 and 58 are configured differently. The center axis 62 is the geometric center of the attachment of the contact element 56 to the lever 15. The first contact region 57 is at a first distance (c) to the center axis 62. As shown in FIG. 11, the contact element 56 is pushed onto the lever 15.

In FIG. 12, the contact element 56 is rotated by 180° about the center axis 62 and pushed onto the lever 15. In this position, the second contact region 58 comes into engagement with the transmitting element 77 which is at a second distance (d) to the center axis 62. The second distance (d) is greater than the first distance (c). By changing the insertion of the contact element 56, the distance between the center axis 62 and the transmitting element 77 can be adapted during assembly of the chain saw 1. The distance is especially adapted for a pregiven position, for example, in the idle position or in the full throttle position. As shown in FIGS. 11 and 12, a symbol, namely a square or a triangle on the contact element 56 is assigned to each contact region (57, 58) in order to facilitate a simple allocation during the assembly. Colored characters or the like can be provided in lieu of the symbols.

Figure 14:
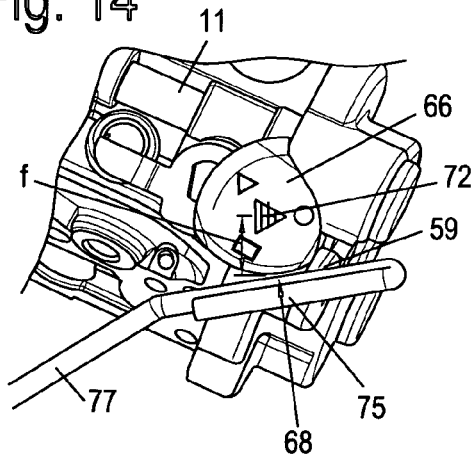
FIG. 14 shows the carburetor of FIG. 13 with the contact element in a second position; and, FIG. 15 shows the carburetor of FIG. 13 with the contact element in a third position.
Figure 15:
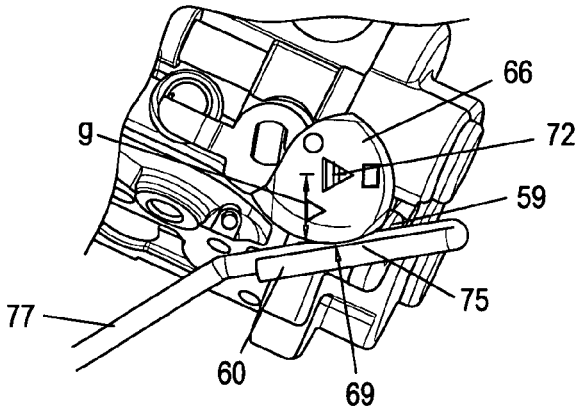

A further embodiment of a contact element 66 is shown in FIGS. 13 to 15. The contact element 66 has three contact regions (67, 68, 69). The contact element 66 can be pushed onto a receptacle having a triangular cross section in three different positions on the lever 15. In the position shown in FIG. 13, a first contact region 67 comes into engagement with an actuating section 75 which is at a first distance (e) to a center axis 72 of the insert receptacle of the contact element 66. In the rotated position of the contact element 66 shown in FIG. 14, a second contact region 68 comes into engagement with the actuating section 75. The second contact region 68 is at a second distance (f) to the center axis which is greater than the distance (e).

In a third position shown in FIG. 15, a third contact region 69 comes into engagement with the actuating section 75 which is at a third distance (g) to the center axis 72. The third distance (g) is greater than the second distance (f). In this way, the actuation of the throttle element can be adapted in a simple manner. In this way, it can be ensured that the entire operating range from idle position to full throttle position can be transmitted via the transmitting unit 13. Furthermore, in FIG. 15, the bent over end 60 of the transmitting element 77 is shown on which the actuating section 75 is formed and which projects in a direction toward the rearward handle of the chain saw 1.

Not only tolerances can be compensated via the contact regions (57, 58, 67, 68, 69). Additionally or alternatively to the tolerance compensation, also the course of forces for the actuation can be adapted via a suitable selection of a contour of the contact regions (57, 58, 67, 68, 69).

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

a housing;

an internal combustion engine mounted in said housing;

a fuel-metering unit for metering fuel to said internal combustion engine and said fuel-metering unit also being mounted in said housing;

a handle;

at least one antivibration element connecting said handle to said housing;

said handle and said housing conjointly defining a vibration gap therebetween;

a throttle lever pivotally journalled on said handle so as to execute a pivotal movement;

a transmitting unit for transmitting said pivotal movement of said throttle lever to said fuel-metering unit;

said transmitting unit including: a rigid transmitting element for bridging said vibration gap; and, support means for rotatably supporting said transmitting element so as to permit rotation thereof about a rotational axis transverse to said vibration gap;

interface means for operatively connecting said throttle lever to said transmitting element so as to cause said transmitting element to transmit said pivotal movement as a rotation about said rotational axis;

said support means including a bearing unit located on said fuel-metering unit and said bearing unit being configured to rotatably support said transmitting element;

said fuel-metering unit including a pivotally journalled throttle shaft;

said transmitting unit being operatively connected to said shaft so as to act thereupon;

said bearing unit being arranged on said throttle shaft; and, said bearing unit being configured as a bearing element rotatably mounted on said throttle shaft.

2. The handheld work apparatus of claim 1, wherein said bearing unit defines an opening extending in the direction of said rotational axis; and, said transmitting element extends through said opening.

3. The handheld work apparatus of claim 1, said transmitting unit further including a contact element having a contact region and being operatively connected to said fuel-metering unit; and, said transmitting element being configured to act on said contact element at said contact region in response to said rotation of said transmitting element about said rotational axis.

4. The handheld work apparatus of claim 3, said contact region being defined by plastic.

5. The handheld work apparatus of claim 1, wherein said bearing unit is a first bearing unit and said support means further comprises a second bearing unit for rotatably supporting said transmitting element next to said handle.

6. The handheld work apparatus of claim 5, wherein said second bearing unit includes a receptacle for accommodating and holding said transmitting element.

7. The handheld work apparatus of claim 6, wherein said handle comprises a handle housing; and, a first handle shell formed on said handle housing and a second handle shell disposed on said first handle shell.

8. The handheld work apparatus of claim 7, wherein said second handle shell has a guide formed thereon for accommodating said throttle lever.

9. A handheld work apparatus comprising:

a housing;

an internal combustion engine mounted in said housing;

a fuel-metering unit for metering fuel to said internal combustion engine and said fuel-metering unit also being mounted in said housing;

a handle;

at least one antivibration element connecting said handle to said housing;

said handle and said housing conjointly defining a vibration gap therebetween;

a throttle lever pivotally journalled on said handle so as to execute a pivotal movement;

a transmitting unit for transmitting said pivotal movement of said throttle lever to said fuel-metering unit;

said transmitting unit including: a rigid transmitting element for bridging said vibration gap; and, support means for rotatably supporting said transmitting element so as to permit rotation thereof about a rotational axis transverse to said vibration gap;

interface means for operatively connecting said throttle lever to said transmitting element so as to cause said transmitting element to transmit said pivotal movement as a rotation about said rotational axis;

said support means including a bearing unit located on said fuel-metering unit and said bearing unit being configured to rotatably support said transmitting element;

said fuel-metering unit including a pivotally journalled throttle shaft on which said transmitting unit acts;

said transmitting unit further including a contact element connected to said throttle shaft at an attachment having a geometric center;

said contact element having a center axis corresponding to said geometric center;

said contact element having a first contact region and a second contact region; said first and second contact regions being configured to have contours different from one another and/or to be at different distances (c, d) from said center axis; and, said contact element being mountable in a first position on said throttle shaft whereat said first contact region is acted upon by said transmitting element and is mountable in a second position whereat said second contact region is acted upon by said transmitting element.

10. The handheld work apparatus of claim 9, wherein said fuel-metering unit includes a connecting flange; and, said bearing unit is arranged on said connecting flange.

11. A handheld work apparatus comprising:

a housing;

an internal combustion engine mounted in said housing;

a fuel-metering unit for metering fuel to said internal combustion engine and said fuel-metering unit also being mounted in said housing;

a handle;

at least one antivibration element connecting said handle to said housing;

said handle and said housing conjointly defining a vibration gap therebetween;

a throttle lever pivotally journalled on said handle so as to execute a pivotal movement;

a transmitting unit for transmitting said pivotal movement of said throttle lever to said fuel-metering unit;

said transmitting unit including: a rigid transmitting element for bridging said vibration gap; and, support means for rotatably supporting said transmitting element so as to permit rotation thereof about a rotational axis transverse to said vibration gap;

interface means for operatively connecting said throttle lever to said transmitting element so as to cause said transmitting element to transmit said pivotal movement as a rotation about said rotational axis;

said support means including a bearing unit located on said fuel-metering unit and said bearing unit being configured to rotatably support said transmitting element;

said bearing unit being a first bearing unit and said support means further comprising a second bearing unit for rotatably supporting said transmitting element next to said handle;

said second bearing unit including a receptacle for accommodating and holding said transmitting element;

said handle comprising a handle housing; and, a first handle shell formed on said handle housing and a second handle shell disposed on said first handle shell; and, said second handle shell securing said transmitting element in said receptacle.

12. The handheld work apparatus of claim 11, wherein said second handle shell includes a U-shaped bracket engaging over said receptacle of said second bearing unit.

* * * * *